US005926927A

United States Patent [19]

Winkler

[11] Patent Number: 5,926,927

[45] Date of Patent: Jul. 27, 1999

[54] ENHANCED ADJUSTABLE SLIDER BUCKLE MEANS

[76] Inventor: Marvin Winkler, P.O. Box 57021, Irvine, Calif. 92619-0721

[21] Appl. No.: 08/990,196

[22] Filed: Dec. 13, 1997

[51] Int. Cl.[6] ..... A44B 11/12

[52] U.S. Cl. ..... 24/585; 24/68 R

[58] Field of Search ..... 24/580, 585, 24

[56] References Cited

U.S. PATENT DOCUMENTS

| | | | |
|---|---|---|---|
| 2,888,729 | 6/1959 | Lethern et al. | 24/585 |
| 3,956,802 | 5/1976 | Kanzaka | 24/585 |
| 4,780,939 | 11/1988 | Belter et al. | 24/585 |
| 5,752,298 | 5/1998 | Howell | 24/585 |

*Primary Examiner*—James R. Brittain

*Attorney, Agent, or Firm*—Peter Jon Gluck; Patent Law Firm, P.C.; Intellepharm, Inc.

[57] ABSTRACT

Adjustable slider buckle means for bracing clothing upon the body of a user includes at least one of ratchet biased closure means and the like selectively adjustable mechanisms in complement with a variable width coupling means. Ready adjustability of, for example, a cinch dimension of the waist band of surf shorts is provided—and a process is likewise taught for adjustin the same simply, irrespective of extreme conditions or externalities such as timing or durational constraints or the fact that a user may be partially or fully submerged in an aqueous environment.

3 Claims, 6 Drawing Sheets

ENHANCED ADJUSTABLE SLIDER BUCKLE MEANS

BACKGROUND OF THE INVENTION

1. Field of the Invention

The present invention relates to apparatus and methods used to fixingly brace clothing around the body of a user. Particularly, the present invention relates to buckle means for rapidly adjusting and maintaining a desired tension level in, for example, clothing which a user wishes to have a desired dimension relative to the user's body, which may need to be changed from time to time. A typical example is used to explain the utility of the present invention and may be found in the waist band of a pair of trunks used during surfing. No limitations of applicant's subject matter are intended by this illustrative example, offered for consideration for the purpose of demonstrating a preferred embodiment of the present invention. Applications in the apparel arts abound, although clothing used for athletic endeavors is particularly susceptible to needs for the present invention.

2. Description of the Prior Art

It is known that changes in the length dimension of various aspects of a user's clothing are useful for maintaining a desired fit. Numerous attempts have focused upon ways to change and maintain particular size dimensions. At least two separate problems are addressed by the instant teachings—namely rapid adjustment of, continuing with the example, the waist of a garment and reliable fixation of the same.

Conventional belts for securing waist bands often rely upon a buckle being secured at one end of the belt permanently, and a multiplicity of punched holes—or other securing mechanisms. A user adjusts such a known belt by inserting a tongue mechanism into the desired punched hole. The result is analogous to tying a length of string about the waist of a user to secure the clothing, bracingly to the user. Mechanical stresses also change the adjusted fit.

The drawback with these type of closure and tightening systems is that it is difficult to change their settings rapidly, or adjust them variably to different settings without creating further problems while doing so. Adjustable waist dimensions are particularly important when used, for example, in the practice of athletic endeavors. Surfing, and water based sporting events in general, are prime examples of this longstanding problem, and the need for the present invention.

A user's needs for differing tension in the waist band of surf trunks is dictated by a plurality of externalities, including the water and other uncontrollable aspects of nature. In sum, it may be beneficial to have the ability to fixingly set a desired tension level for the purpose of preventing trunks from slipping from a first to a second position while engaged in surfing. Likewise, a user's need to re-adjust a desired tension level may be a function of time or the changed size of the user.

Among skilled practitioners, at this point in time, shortfalls with the use of known adjustable and fixed closure systems for surf shorts and the like clothing means abound. Likewise, such technology is generally incapable of providing ready adjustability increasingly demanded by today's consuming public.

Accordingly, to solve this longstanding problem in the instant field of art, the present inventor has researched mechanisms which would remedy the above situation and ameliorate known pitfalls. The teachings of the present invention are thus offered for consideration to overcome these problems which remain inadequately addressed to date.

In a review of the art, the two divergent sets of patents which are both available and relevant do not provide adequate resolution of the issues impacted upon by the present invention. Adjustable buckles are difficult to fix reliably, and mechanical failures or difficulty in changing settings also provides major obstacles. Accordingly, the following U.S. Letters Patents were examined and found to militate toward patentability of the instant disclosure:

U.S. Pat. Nos. 5,673,463; 5,609,281; 5,575,010; 5,315,716; 5,299,323; 5,048,865; 4,928,364; & 4,287,611.

For example, U.S. Letters Pat. No. 5,673,463 (Chang) issued Oct. 7, 1997 discloses a micro-adjustable buckle having no fail-safe securing means. In typical fashion, an end of the belt is inserted through a securing element provided at the end of a serrated plate. The present invention differs in that once closed it will not become loosened as this prior art belt is likely to do.

Likewise, U.S. Letters Pat. No. 5,609,281 (West) issued Mar. 11, 1997, and assigned to Sharp Kabushiki Kaisha discloses a known buckle means with an attached set of tools. Nothing shown addresses rapid readjustment, as taught by the present invention.

U.S. Letters Pat. No. 5,048,865 (Tokugawa), assigned to Nippon Seiko Kabushiki Kaisha and issued Sep. 17, 1991 discloses a vehicle belt system having ready releasability—but is not appropriate for use with surf trouser means, wetsuits or the like active-casual-leisure wear, or the lie apparel means.

U.S. Letters Pat. No. 4,928,364 (Ikeda) issued May 29, 1990 discloses a readily releasable buckle-type which also is made incapable of withdrawal, as is the present invention. However, this patent requires a first buckle body and a second buckle body making it less efficient, more expensive, and bulkier than the apparatus and process of the present invention.

While these disclosures are readily distinguishable from the instant teachings, they are incorporated expressly herein by reference, being representative of the state of the art in buckle and belt securing technology, particularly in regard to the problems solved by the teachings of the present invention.

Likewise, those systems directed toward the adjustability of pants and related apparel focus upon the problem solved by applicant but do not overcome it. Snaps, looped fasteners, elaborate hem changing mechanisms and overlapping seams are respectively urged by U.S. Letters Pat. Nos. 5,575,010; 5,315,716; 5,299,323 and 4,287,611 to solve the instant problem. None of the art reviewed, or the solutions presented, works as effectively as the present invention. Pants for tuxedos, for example, have related closure needs and attempts to reliably and adjustably regulate same have been largely constrained by at least one of dependability over time and easy of snapping, or related attachment concerns.

In fact, no known disclosure solves the long felt need for readily adjustable, but reliably fixed short pants for surfing. The present invention, conceived and reduced to practice for this reason, accordingly constitutes progress in science and the useful arts for both this and related or equivalent applications throughout the apparel and garment industry.

OBECTS AND SUMMARY OF THE INVENTION

It is an important object of the present invention to provide an improved means for gaining a mechanical advantage over known apparel selective dimensioning means, relative to a user's body, by imposing a locking biased means for achieving the same which overcomes drawbacks of the prior art.

An additional object of the present invention is to utilize or impose locking biased mechanically advantageous means which can be adjusted by a user while being worn, for example by providing a slider mechanism for readily adjusting a length dimension of the waist of clothing worn by a user.

Another object of the present invention is to provide an improved adjustable slider buckle means which overcomes the drawbacks of the prior art by being capable of reliable fixation once adjusted to a desired setting relative to a user.

Yet another object of the present invention is to substantially shorten the timing of intervals required for rapidly adjusting a desired dimensional aspect of clothing, particularly shorts used while performing athletics, such as surfing.

Yet a still further object of the present invention is to provide a process of using the apparatus of the present invention with known and undeveloped systems requiring ready adjustment and fixed fastening.

Briefly stated, adjustable slider buckle means for bracing clothing upon the body of a user includes at least one of ratchet biased closure means and the like selectively variable closing systems and mechanisms in complement with a variable width coupling means. Ready adjustability of, for example, a cinch dimension of the waist band of surf shorts is provided—and a process is likewise taught for adjusting the same simply.

According to a feature of the present invention there is provided a means for securing apparel about a desired portion of the body of a user, comprising, in combination; at least one slider mechanism, further comprising; a worm gear, a staple like contact plate, a lower jaw, one upper jaw, and means for selectively adjusting and reliably securing each said jaw in at least a first, a second, and a third position, wherein each said at least one slider mechanism is affixed to a circumference of fabric disposable at a desired tension about the body of a user.

According to another feature of the present invention, there is provided, in an adjustable waist band effective for securing apparel about the midsection of a user, the improvement comprising, in combination; at least an adjustable slider which further comprises, a lever, a carriage, a ratcheted worm gear, means for slideably adjusting said at least one adjustable slider, locking means for moving said lever from a first to a second position and means for fixedly engaging a swatch of fabric.

According to yet another feature of the present invention, there is provided a process for adjusting the waist dimension of apparel comprising the steps of providing at least one novel enhanced slider mechanism, positioning said slider mechanism to provide a desired cinch dimension, locking said slider, and repeating each of said steps to provide for an additional desired setting.

The characteristics and advantages of the invention are further sufficiently referred to in connection with the accompanying drawings, which represent at least one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWING FIGURES

With the above and related objects in view, the invention consists in the details of the construction and combination of parts, as will be more fully understood from the following description, when read in conjunction with the accompanying drawings and numbered parts, in which:

FIG. 1 is a view of an apparatus embodying a version of the present invention in an opened position, having the lever and carriage detached to show mechanical details of operation of this preferred embodiment;

FIG. 2 likewise depicts the apparatus of the present invention, as shown in FIG. 1, however this view shows the lever and carriage attached and the mechanism is in a released position, according to an embodiment of the present invention, and teachings related to the method of use of same;

Figure 8:
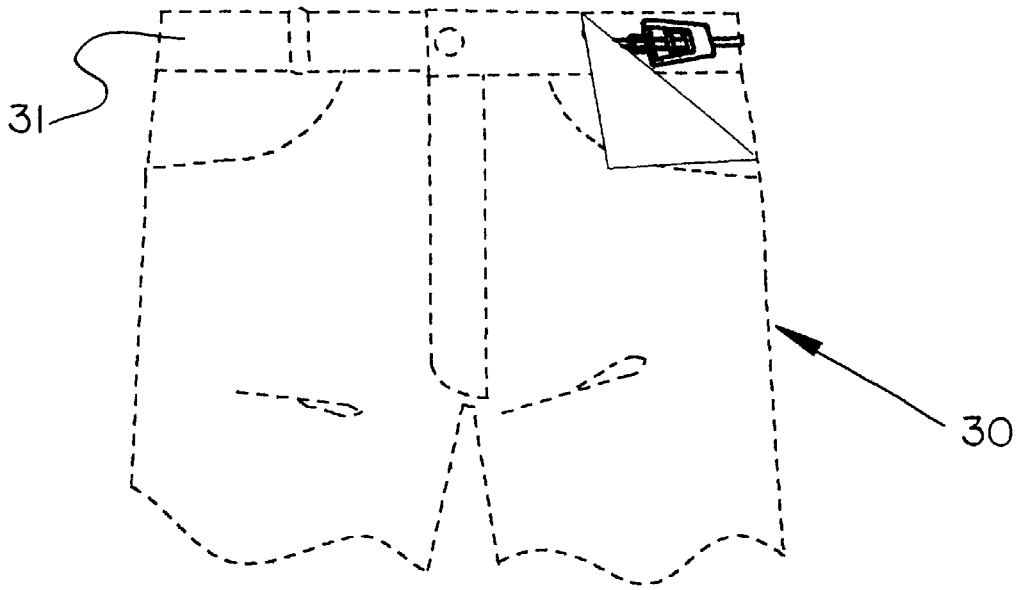
Figure 9:
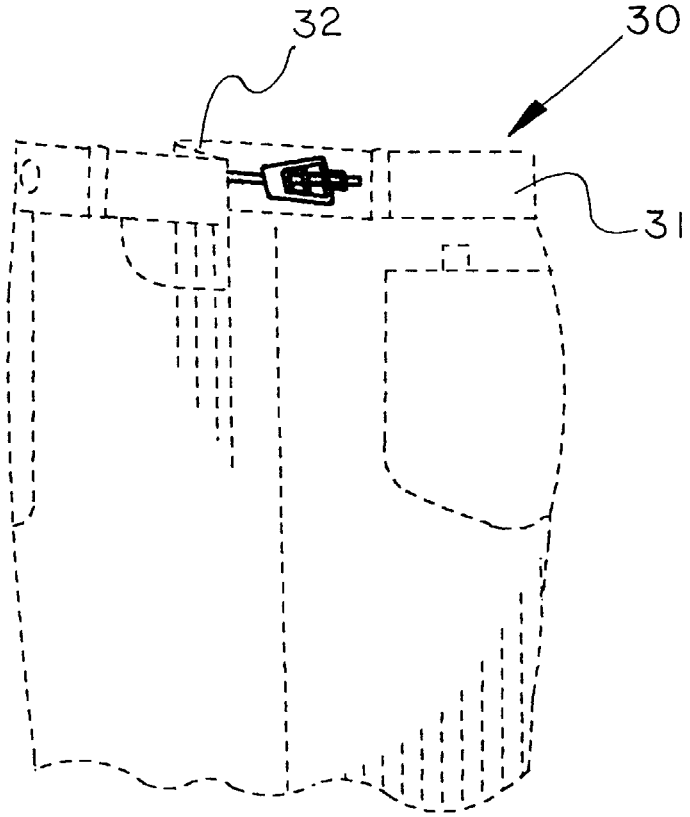
Figure 10:
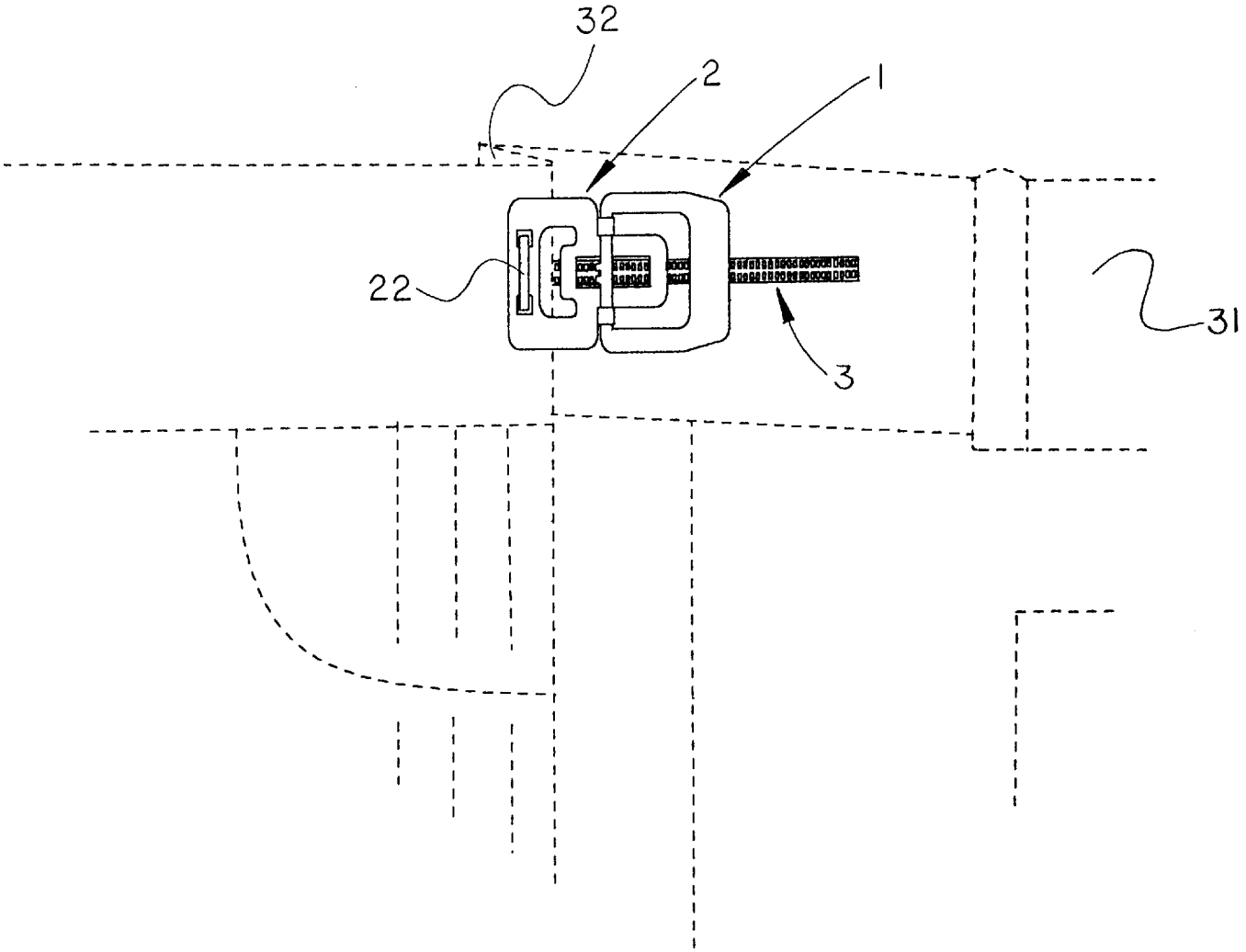

FIG. 8 likewise depicts a right side view of the present invention as applied to an appropriate item of substrate apparel means, wherein one of two slider mechanism is shown the other being obscured by a flap of fabric;

FIG. 9 shows an alternate preferred embodiment the present invention as applied to an appropriate item of substrate apparel means; and FIG. 10 is a detailed view of a preferred embodiment of the present invention as applied to an appropriate item of substrate apparel means.

DETAILED DESCRIPTION OP THE INVENTION

The present inventor has discovered that during surfing, shorts which do not maintain a desired position relative to a user's body present significant difficulties. Likewise, it has been discovered that once a preferred pair of shorts has changed size relative to a user from at least one of shrinkage, variables derived from the changing face of natural conditions, and increases in size by a user, issues arise related to comfort, fit and functional utility.

For the purpose of the following description of a preferred embodiment of the present invention, the NOVEL ENHANCED ADJUSTABLE SLIDER BUCKLE MEANS which is described herein, and claimed below is styled 'slider' referring to each individual mechanical device which is effective for being attached to a substrate (for example the waist band of a user) and having both an lower carriage and a lever which grips fabric by moving from a first to a second position. Likewise, each slider, or pair of sliders, may be positioned at a predetermined setting along (for example) a waist band, or fixed.

The present invention eliminates these concurrently existing situations with one apparatus, or slider, which works alone, in combination with another slider, or any other means for providing a desired clothing fit, or 'cinch dimension.' For the purposes of the instant application a cinch dimension comprises the width of fabric required to dispose a circumferential strip of fabric (for example, as discussed in connection with a preferred embodiment hereafter, the waist band of surf trunks, shortened trousers ['shorts'] or the like surfware for covering portions of a user's trunk at or about the waist region.).

Figure 1:
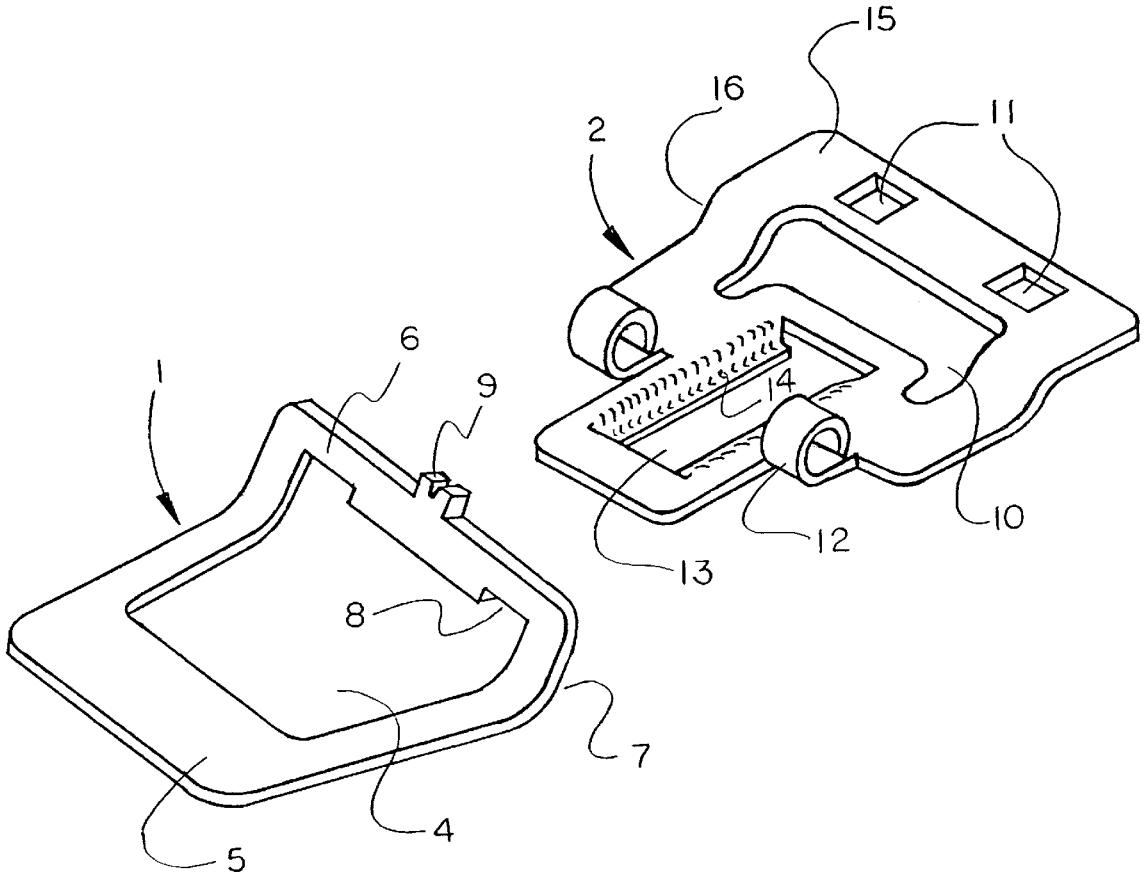

Referring now to FIG. 1, a partially exploded view of a slider mechanism according to teachings of the present invention is shown. Lever 1 is shown as disconnected from carriage 2 sole for illustrative purposes and for the ease of viewing. This view of a preferred embodiment of the present invention is offered for consideration merely to provide internal and external views of a mechanism of a preferred embodiment in operationally functional detail.

Sliding engagement and adjustment of a preferred embodiment of the present invention is accomplished by way of a worm gear 3 (not shown) which rachetedly engages guiding jaws 14, at the urging of a user to achieve a desired cinch dimension.

Lever 1 is defined by primary aperture 4, disposed at a central portion thereof. A first end of lever 1 sports crown 5, which is effective for being moved from a first to a second position, whereby the same is locked to bracingly engage a desired swatch of fabric (not shown).

Likewise, a second end of lever 1 features hinge shoulder 6, with toothed key 9 disposed at a point midway thereupon. First angle 7 connects hinge shoulder 6 with crown 5. An inside edge of hinge shoulder 6 is further defined by notches 8 performing a fail-safe locking function, as described further below.

Carriage 2 further includes squared apertures 11 effective for receiving staple like plate means as defined relative to two points spaced apart on offset shoulder 15 which slopes along offsetting angle 16 to a lower portion of carriage 2. This lower portion of carriage 2 includes curled hinges 12 disposed on either side of jaw opening 13 having guiding jaws 14 arranged thereupon on inside edges.

Figure 2:
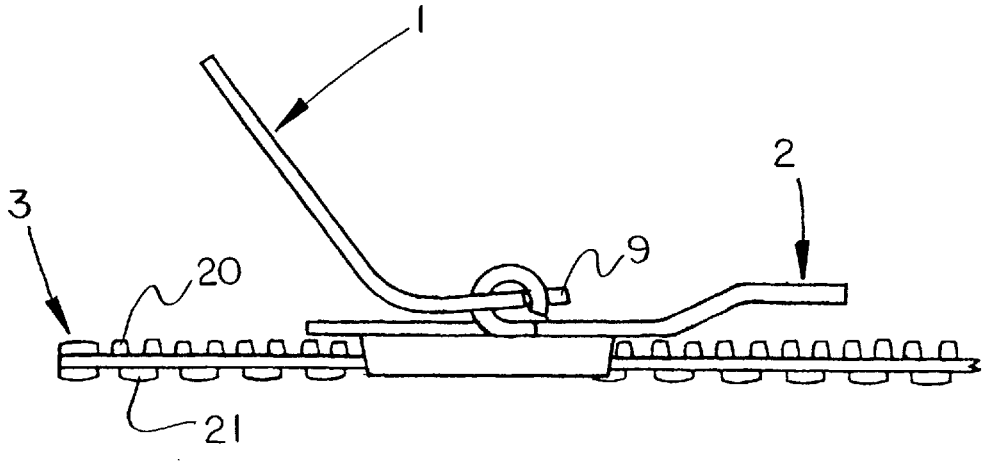

Referring now to FIG. 2, lever 1 is shown in a released position relative to carriage 2. Toothed key 8 is not engaged while worm gear 3 having guidance notches 21 notches 21 adjustingly position the slider mechanism assembly.

Figure 3:
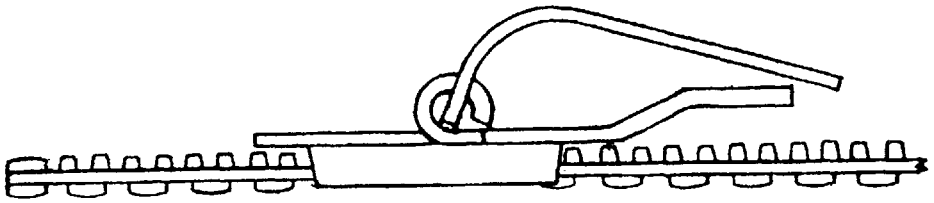
FIG. 3 illustrates another view of the apparatus depicted in FIG. 1 & FIG. 2, with the mechanism in a locked or closed position according to an embodiment of the present invention, and teachings related to the method of use of same.

Referring now to FIG. 3, lever 1 is moved to a locked position relative to carriage 2, and according to a preferred embodiment of the present invention a swatch of fabric (not shown) is bracingly engaged therein.

Figure 4:
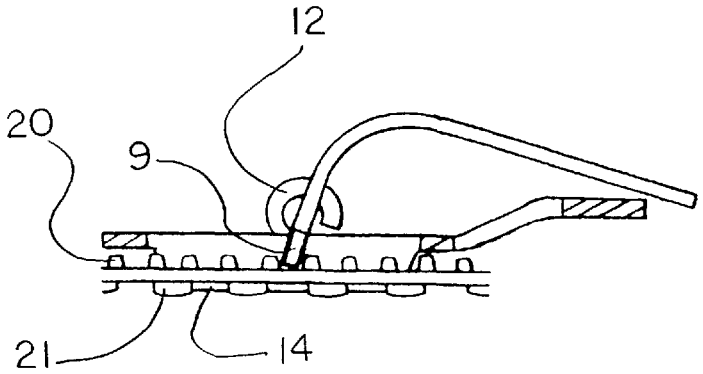
FIG. 4 is a break away view of a carriage, according to an embodiment of the present invention, and teachings related to the method of use of same.

Referring now to FIG. 4, carriage 2 is shown in a partial break away view with lever 1 in a locked position relative to carriage 2. Locking teeth 20 matingly engage toothed key 9 when lever 1 in a second, or locked position. Guiding jaws 14 and guidance notches 21 matingly provide mechanical stability and provide for anchoring of a slider mechanism to appropriate substrates according to the present invention. Those of skill in the art likewise will understand from the foregoing description how to bracingly engage fabric about the waist of a user by way of the instant means.

Figure 5:
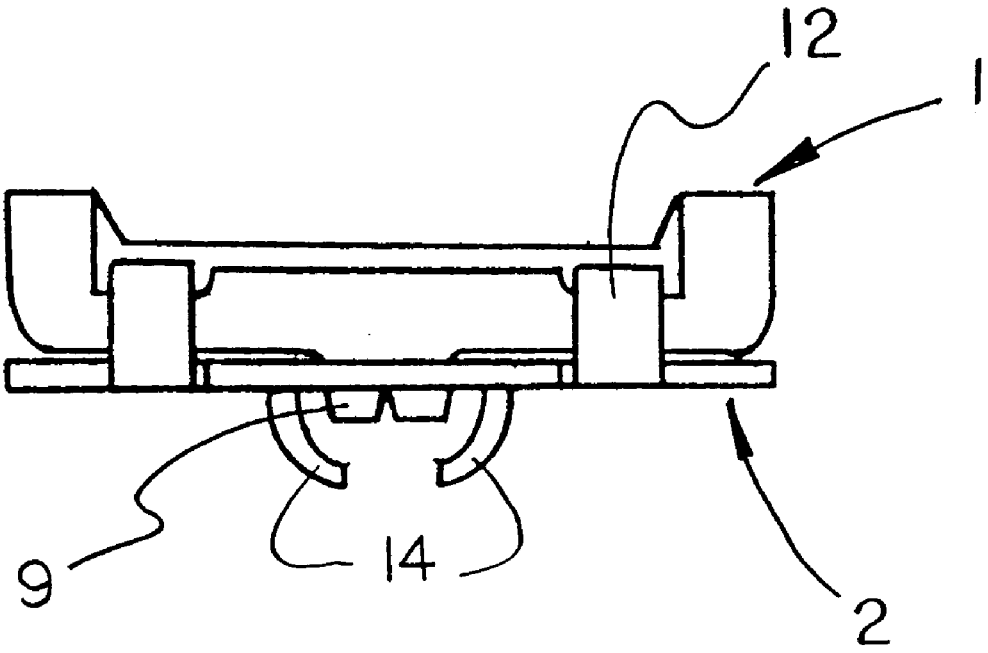
FIG. 5 is a front view of the entire mechanism in a closed position, according to an embodiment of the present invention, and teachings related to the method of use of same; and, FIG. 6 is a cross sectional view showing the ratchet/worm gear, according to an embodiment of the present invention, and teachings related to the method of use of same.

Referring now to FIG. 5 a front view of the slider mechanism in a closed position shows lever 1 and carriage 2 connected by way of a curled hinge means 12. Guiding jaws 14 and hinged tooth 9 project below carriage 2.

Figure 6:
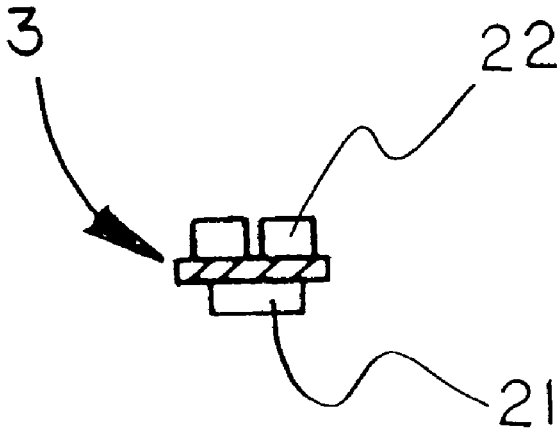

Referring now to FIG. 6, a cross-sectional view of ratcheted worm gear 3 shows locking teeth 20 disposed upon one edge and guidance notches 21 upon a second edge. In order to fixingly and reliably brace clothing about, for example, the waist of a user operation of the device according to the present invention demonstrates a simple elegance of design qualifying the same as invention worthy of classification as progress in science and the useful arts.

Namely, worm gear 3 may be disposed about a portion of, for example, the waist band of a user's surf shorts as two regions spaced equidistant from a central portion which intersects an axis extending through a midpoint of a user from her clavicle to the bottom of her crotch region. Each respective piece of worm gear means being at least several inches long, a region of adjustability is defined thereby. Each respective SLIDER assembly is mounted within the region or zone of adjustability, with toothed key 9 allowing for locking engagement of the SLIDER at any point with this zone. Lever 1 is moved from a first (open or recessed position) to a second (closed or locked) position, with a swatch of fabric from the same localized region trapped between lever 1 and staple like plate means 122, fitted into the squared apertures 11 of carriage 2. The same steps are repeated, in this example, for a second SLIDER, thus allowing a cinch dimension (or a desired circumferential waist length) to be achieved. The adjustment may be reconfigured at the user's whim, and without any concern for it coming apart, due to the fail-safe nature of toothed key 9 and guiding jaws 14.

Figure 7:
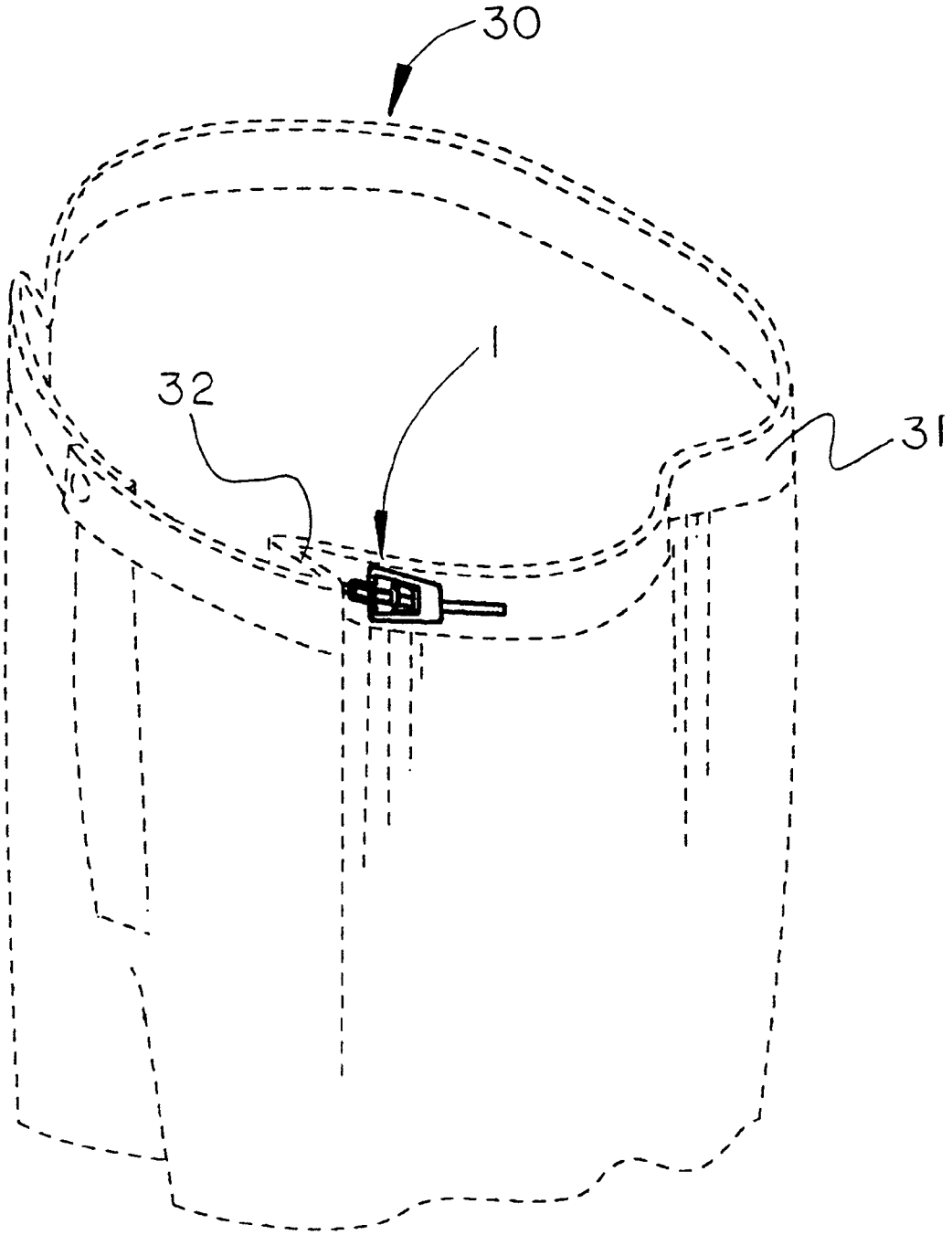
FIG. 7 shows a cut-away view of a preferred embodiment of the present invention as applied to an appropriate item of substrate apparel means.

Referring now to FIG. 7, an illustration depicting a preferred embodiment of the present invention applies the same to a pair of shorts, for example, for surfing or for walking. According to the novel combination of the present invention it is further contemplated that guiding jaws 14 (FIG. 1 & FIG. 5) be of variable width, contingent upon the desired application.

Accordingly, the instant means for bracingly suspending apparel about the waist of a user may be used with specially designed garments, or retrofitted upon existing appropriately styled clothing or the like means. The present inventor has used ratcheted worm gears of varying dimensions and lengths, depending upon the desired application—or that use to which a user intends to put the item.

FIG. 7 shows a cut away view of trunks for surfing wherein a dual slider arrangement allows for rapid and dependable fixation of, for example, the illustrated embodiment which has been found to be particularly effective for use within the suring context. A second slider mechanism is obscured to the right of the crotch region of apparel 30.

According to the illustrated preferred embodiment shown in FIG. 7, a user moves lever 1 from a first to a second position to engage the instant locking mechanism as detailed in the prior figures. Fabric swatch 32 may be used as a flapping means for covering the instant slider mechanism, and shielding an outer surface of lever 1 same from exposure (to for example, a surfboard). Staple-like plate means 122 (not shown) may be attached to a proximate section of waist band 31, and the same 31 may be shortened by sliding the carriage 2 (with lever 1 in an open position) along ratcheded worm gear 3's length (in the direction of the crotch area of a user) until a desired cinch dimension is achieved. Lever 2 is then moved to a closed position (as shown) lockingly engaging the slider mechanism of the present invention. According to this preferred embodiment, the entire circumferential length of waist band 31 is adjusted, making the fit of the instant apparel 30 more comfortable. Likewise, a series of adjustments may be made, without worries as to mechanical reliability.

Referring now to FIG. 8, shortened pants 30 may include only one slider mechanism, and the same may be positioned relative to flapping means for covering, pockets, and the like. Similarly, the slider may be adorned with, for example, an appropriate corporate logo mountingly affixed upon an outer surface of lever 1, with the same being disposed directly within the field of view of an observer when lever 1 moved from a first to a second position.

Referring now to FIG. 9, an alternate preferred embodiment may feature slider mechanism rotated 180 degrees from a position depicted in FIG. 7 and FIG. 8, and swatch of fabric 32 loosened by changing its position relative to carriage 2. According to this embodiment, fabric 32 may be attached directly to ratched worm gear 3, and the length of waist band 31 increased by moving lever 1 from a closed position to an open position, sliding the carriage 2 away from the crotch of a user, and again moving lever 1 to a closed postion. According to this embodiment supplemental retention means prevent slider from being extended past a second end of ratcheded worm gear 3.

Referring now to FIG. 10, a detailed view of the first preferred embodiment is offered for consideration. This view features staple like plate means 122 anchoring carriage 2 to an appropriate stitched substrate of fabric swatch 32, of waist band 31. A user easily moves lever 1 from a first to a second position once the desired waist dimension is set. Slider mechanism is then lockingly engaged, as described in detail above.

Likewise, the present inventor has contemplated that lever 1 may move from a recessed to a locked position with ratchet means governing the same. Those having a modicum of skill in the art will readily understand this combination, in addition to many and varied uses of the instant invention in analogous ways with related arts.

The characteristics and advantages of the invention are further sufficiently referred to in connection with the accompanying drawings, which represent a preferred embodiment. After careful consideration of this example, skilled persons will understand that variations may be made without departing from the principles disclosed, the spirit or meaning of the invention, and thus we contemplate the employment of any structures, arrangement or modes of operation that are properly within the scope of the appended claims.

What is claimed is:

1. In a means for bracingly suspending apparel about a user, comprising, in combination:

at least one slider mechanism, including a carriage having an upper portion and an underside;

means for trackingly disposing said at least one slider mechanism upon a path defined by a predetermined zone of adjustment; said means for trackingly disposing including a worm gear having locking teeth disposed on a top surface thereof; and, means for lockingly engaging said at least one slider mechanism with said locking teeth; whereby a circumferential length of a fixed portion of fabric is reliably maintained by the imposed mechanical advantage of said means for lockingly engaging, the improvement comprising, in combination; notched guiding jaws located on said underside of said carriage and centrally disposed thereon; and guidance notches disposed upon a bottom surface of said worm gear;

whereby said jaws and said notches may be ratchedly engaged to position said slider mechanism to provide a desired cinch dimension prior to securing said slider mechanism in a fail-safe manner by lockingly engaging said slider mechanism with said locking teeth.

2. Apparatus as defined by claim 1, wherein said at least one slider mechanism further comprises a pair of slider mechanisms.

3. Apparatus as defined by claim 1, whereby a user can adjust said at least one slider mechanism while immersed in water, and reliably move said at least one slider mechanism from a first to a second position in said zone of adjustment.

* * * * *